US009799471B2

(12) United States Patent
Kralik

(10) Patent No.: US 9,799,471 B2
(45) Date of Patent: Oct. 24, 2017

(54) MULTIPOLAR POWER CONTACTOR

(71) Applicant: Schaltbau Gmbh, Munich (DE)

(72) Inventor: Robert Kralik, Poing (DE)

(73) Assignee: Schaltbau GmbH, Munich (DE)

( * ) Notice: Subject to any disclaimer, the term of this patent is extended or adjusted under 35 U.S.C. 154(b) by 0 days.

(21) Appl. No.: 15/300,749

(22) PCT Filed: Jan. 22, 2015

(86) PCT No.: PCT/EP2015/000124

§ 371 (c)(1),
(2) Date: Sep. 29, 2016

(87) PCT Pub. No.: WO2015/149895

PCT Pub. Date: Oct. 8, 2015

(65) Prior Publication Data

US 2017/0062156 A1 Mar. 2, 2017

(30) Foreign Application Priority Data

Mar. 31, 2014 (DE) ..... 10 2014 004 665

(51) Int. Cl.
*H01H 9/02* (2006.01)
*H01H 33/08* (2006.01)
(Continued)

(52) U.S. Cl.
CPC ..... *H01H 33/08* (2013.01); *H01H 9/30* (2013.01); *H01H 33/38* (2013.01); *H01H 2009/305* (2013.01)

(58) Field of Classification Search
CPC ..... H01H 33/08; H01H 33/38; H01H 9/30
(Continued)

(56) References Cited

U.S. PATENT DOCUMENTS 3,485,979 A * 12/1969 Mercier ..... H02H 7/16 218/143
5,084,600 A * 1/1992 Seki ..... H01H 33/901 218/44

(Continued)

FOREIGN PATENT DOCUMENTS

DE 3609042 A1 9/1986
DE 195 46 763 A1 6/1997

(Continued)

OTHER PUBLICATIONS

International Search Report mailed May 6, 2015 in related PCT/EP2015/000124 (four pages).

*Primary Examiner* — Shawki S Ismail
*Assistant Examiner* — Lisa Homza
(74) *Attorney, Agent, or Firm* — Kilpatrick Townsend & Stockton LLP

(57) ABSTRACT

Disclosed is multipolar power contactor with an electromagnetic drive having an armature, and at least two movable contacts arranged next to one another and connected to the armature. The armature is movable from an open position, where the movable contacts and the fixed contacts are not in contact with one another, into a closed position where the movable contacts come into contact with the fixed contacts. Each movable contact and a corresponding fixed contact, is assigned an arc quenching device, and a plasma barrier having a first and a second barrier is provided between the two movable contacts, whereby one of the two barriers is connected to the armature and the other of the two barriers to a stationary part of the power contactor. The first and the second barrier overlap with one another at least partially in each position of the armature between the open and the closed positions.

11 Claims, 3 Drawing Sheets

Figure 1:
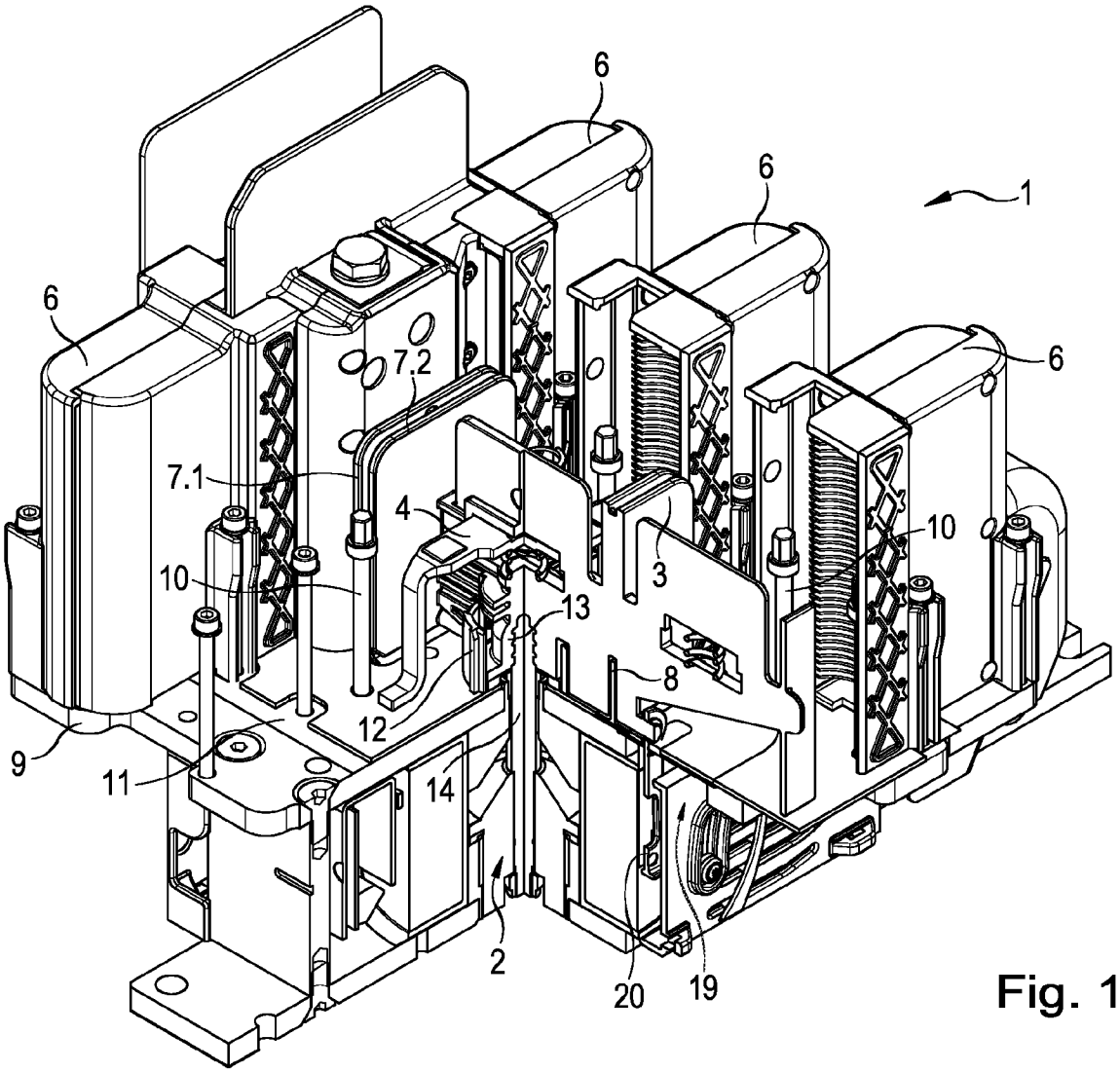

(51) Int. Cl.
*H01H 9/30* (2006.01)
*H01H 33/38* (2006.01)

(58) Field of Classification Search
USPC ..... 335/202
See application file for complete search history.

(56) References Cited

U.S. PATENT DOCUMENTS 5,406,440 A * 4/1995 Wieloch ..... H01H 47/325 327/385
5,635,886 A * 6/1997 Pichard ..... H01H 73/045 335/132
6,013,889 A * 1/2000 Wieloch ..... H01H 77/10 218/22
6,037,555 A * 3/2000 Castonguay ..... H01H 1/2058 200/306
6,407,354 B1 * 6/2002 Turner ..... H01H 9/342 218/155
6,417,749 B1 * 7/2002 Kappel ..... H01H 50/026 335/132
6,703,575 B1 * 3/2004 Yamamoto ..... H01H 9/342 218/149
7,115,829 B2 * 10/2006 Schmid ..... H01H 21/42 200/400
7,750,770 B2 * 7/2010 Duchrow ..... H01H 9/342 335/201
2015/0129555 A1 * 5/2015 Jang ..... H01H 9/04 218/157

FOREIGN PATENT DOCUMENTS

DE 10 2011 076 290 A1 11/2012
EP 2 230 678 A2 9/2010
EP 2 365 508 A1 9/2011
FR 2 519 186 A1 12/1981

* cited by examiner

MULTIPOLAR POWER CONTACTOR

This application is a US National Phase of PCT/EP2015/000124, filed Jan. 22, 2015, which claims priority to German Application No. 10 2014 004 665.6, filed Mar. 31, 2014, the entireties of which are incorporated by reference herein.

The present invention relates to a multipolar power contactor with an electromagnetic drive, a movable armature of the drive, and having at least two movable contacts that are arranged next to one another and connected to the armature. Corresponding fixed contacts of the power contactor are assigned to the movable contacts. The armature can move from an open position, in which the movable contacts and the fixed contacts are not in contact with one another, into a closed position in which the movable contacts come into contact with the fixed contacts; further, an arc quenching device is assigned to each contact point that consists of movable contact and corresponding fixed contact in the power contactor of the generic type.

Power contactors of the generic type are in particular used as engine contactors in railcars. Power contactors that are used in railcars have to be able to switch particularly high power levels reliably. Due to engines becoming increasingly performing, also the performance requirements for the engine contactors used are growing. In particular, malfunctions also have to be taken into account in this context. Therefore, it may for example occur that a thyristor fires through in the converter and thus creates a short circuit. In case of malfunction, the electric engine of the railcar acts as a generator and thereby creates power in the range of several 100 KW. The power has to be switched off safely and reliably with the power contactor. The same shall also apply if the malfunction occurs not in the converter but in the contactor itself. Thereby, the frequencies to be switched are in the range between 50 Hz and 400 Hz.

A switching arc will be formed during opening of the contacts. In this type of power contactors, arc quenching devices are provided into which the switching arc is driven by means of a magnetic field and quenched in the process. The higher the powers to be switched, the more difficult it will be to achieve quenching of the switching arc in a short time. In case of an appropriately high power, the switching arc will create a large quantity of electrically conductive plasma that spreads out inside the device under pressure. Due to the plasma, there is the risk of a short circuit being created at different points in the power contactor. In particular, the plasma can cause the switching arc to provoke a short circuit of the contact points of neighboring poles or to permeate to the ground of the unit.

Therefore, the purpose of the present invention consists of improving the power contactor of the generic type and to increase switchability.

The invention is solved by the characteristics of the independent Claim 1. According to said claim, there will be a solution of the problem according to the invention in a power contactor of the generic type if a plasma barrier is arranged between two movable contacts of neighboring poles that are disposed next to one another, whereby the plasma barrier has a first barrier as well as a second barrier, whereby one of the two barriers is connected to the armature and the other of the two barriers is connected to a stationary part of the power contactor, and whereby the first barrier and the second barrier overlap one another at least partially in each position of the armature between the open and the closed position.

The invention prevents plasma, which is created during opening of the contacts due to a switching arc, from flowing from one contact point and/or a chamber that encloses the contact point to a neighboring contact point and/or the associated chamber. This also prevents the switching arc from flashing over onto the neighboring contact point. One of the two barriers is preferably installed on an insulation plate that lies on the yoke plate of the power contactor that is connected indirectly to the yoke plate. To achieve an optimal sealing effect, this barrier preferably closes flush with the yoke plate. The barrier that is connected to the armature can be connected to the armature either directly or indirectly. It is preferably connected to the armature via a contact support.

Further preferably, the distance between the first and the second barrier in the overlap area is smaller than 5 mm, further preferably smaller than 2 mm, and particularly preferably smaller than 1 mm.

Preferred embodiments of the present invention are the object of the sub-claims.

In a particularly preferred embodiment of the present invention, the first barrier and the second barrier interact in the way of a labyrinth seal. In this way, the plasma is prevented with particular effectiveness from moving from one contact point to a neighboring contact point.

The barriers can be implemented particularly easily and cost-efficiently if they are formed respectively by at least one plate. In this respect, it is particularly advantageous in terms of the sealing effect when the first barrier has at least two parallel plates, whereby at least one plate of the second barrier is arranged between the two parallel plates of the first barrier. A particular effective labyrinth seal is achieved due to this. This embodiment is particularly easy to implement when the two parallel plates are fixed on a contact support that is connected to the armature or when they are part of the contact support.

In a further particularly preferred embodiment of the present invention, the barriers are made of plastic or ceramic. These two materials are not electrically conductive, which ensures that there will be no electric conductivity between two neighboring contact points.

In a further particularly preferred embodiment of the present invention, the power contactor has a yoke plate, whereby at least one component of the power contactor, which is installed in direct proximity to one of the contact points on the yoke plate, is fixed on the yoke plate by means of one or multiple plastic screws. The plastic screws are formed preferably as high-strength plastic screws. In this embodiment it is prevented, in contrast to conventional power contactors in which electrically conductive metal screws are used, that a short circuit can be produced onto the grounded yoke plate through plasma and screw. This embodiment is also suitable for screws that are not screwed into the yoke plate of the power contactor but into any grounded component of the power contactor. The components to be fixed are for example housing parts or arc quenching chambers. It should be noted that the use of plastic screws is not only suitable for the power contactor according to the present invention but for power contactors in general. The use of plastic screws for the abovementioned purposes is therefore a separate invention even though it leads to a further improvement of the switchability of the power contactor according to the invention.

In a further preferred embodiment of the present invention, the yoke plate of the power contactor is equipped with an insulation film at least partially on the side that faces the contact points. Thereby, the contact with plasma is prevented and the short circuit risk is further reduced.

In a further particularly preferred embodiment of the present invention, the armature is connected to an actuation axis made of metal, whereby the actuation axis is enclosed at least partially by a stationary insulation sleeve. This prevents plasma, which is created by the arc, from coming in contact with the actuation axis and thereby a short circuit from being produced onto the actuation axis. This embodiment is particularly recommended in cases where the actuation axis is arranged in direct proximity to one of the contact points. For a three-pole power contactor that is used as an engine contactor in railcars, one of the contact bridges (movable contact) is generally installed directly on one end of the actuation axis. The central contact bridge is practically situated in the same plane in which also the actuation axis is situated. In this constellation, there is a significant risk that the plasma, which is created by the arc, will come in contact with the actuation axis. However, this is prevented by the stationary insulation sleeve. The stationary insulation sleeve consequently forms a stationary component of the power contactor and is installed preferably on the insulation plate that lies on the yoke plate. To achieve an optimal sealing effect, the stationary insulation sleeve preferably closes flush with the yoke plate. If the actuation axis is designed in a cylindrical way, it will be possible to implement the stationary insulation sleeve in a hollow cylindrical form. In principle, however, any other cross-section that ensures a sufficient sealing effect can be chosen.

In a particularly preferred embodiment, the actuation axis is enclosed at least partially by a moved insulation sleeve that is movable relative to the stationary insulation sleeve, whereby the moved insulation sleeve is connected firmly to the actuation axis, and whereby the stationary insulation sleeve and the moved insulation sleeve interact in a telescopic way. In this embodiment, the stationary insulation sleeve and the moved insulation sleeve also interact in the way of a labyrinth seal. Therefore, a contact of the plasma, which is created by the switching arc, with the actuation axis is prevented effectively. Preferably, both the stationary insulation sleeve as well as the moved insulation sleeve are made of plastic or ceramic. Further preferably, there is a very short distance between the two sleeves in order to optimize the sealing effect. A distance is preferably smaller than 1 mm.

In a further particularly preferred embodiment of the present invention, the movable contacts and/or the fixed contacts are designed respectively with an arc guide horn, whereby the arc guide horns are tapered at least in a sectional way. It should be noted that the contacts with a tapered arc guide horn are not only suitable for the power contactor according to the invention but in general for the use in power contactors. An embodiment with a tapered arc guide horn as well as the preferred embodiments described in the following are therefore a separate invention, which, however, contributes in the same way to a further optimization of the switchability of the power contactor according to the invention.

An arc guide horn is an extension of the contact that stands out from the respective contact in an angular way and through which the switching arc is guided into the respective arc quenching device after its formation. For this purpose, magnetic fields, which are created by permanent magnets or electromagnets or the electromagnetic blowing effect of specifically formed contact pieces, are used. The tapering of the arc guide horns results in a constriction of the magnetic field lines, which, in turn, leads to a reinforcement of the electromagnetic blowing effect. Therefore, switching of arcs in the low power range can be improved perceptibly. The arc guide horns are preferably kept as narrow as allowed by the lifespan requirements. Preferably, the arc guide horns are tapered in relation to the actual contact area of the respective contact by at least 25%, preferably by at least 50%, in any case.

Particularly preferably, the arc guide horn is designed as a separate component and fixed on the respective fixed contact and/or movable contact. Fixing preferably takes place by means of riveting. Further preferably, the arc guide horns are made of bronze. In this embodiment, a significantly higher lifespan of the arc guide horns will be ensured compared to arc guide horns that are built in a conventional way and that form a complete copper part with the respective contact. It has become apparent that conventional arc guide horns can break early due to vibration load.

In a further preferred embodiment of the present invention, the yoke plate of the power contactor has a breakthrough in the area of one of the contact points, whereby the breakthrough is sealed by means of a foam rubber mat. This embodiment can for example be used if the yoke plate has a breakthrough for a connection part that is connected firmly to the armature and/or contact support and through which an auxiliary switch disposed under the yoke plate is actuated. The foam rubber mat is preferably formed in a way that it encloses the connection part in a sealing way. This embodiment has the advantage that the plasma, which is created by the arc, will not come in contact with the yoke plate via the breakthrough and/or with grounded components of the power contactor that are disposed underneath and thereby create the risk of a short circuit. It should be noted that the seal of a breakthrough by means of a foam rubber mat can not only be implemented in case of the power contactor according to the invention but for power contactors in general. This embodiment therefore represents a separate invention which, however, contributes to further optimization of the switchability of the power contactor according to the invention.

Figure 2:
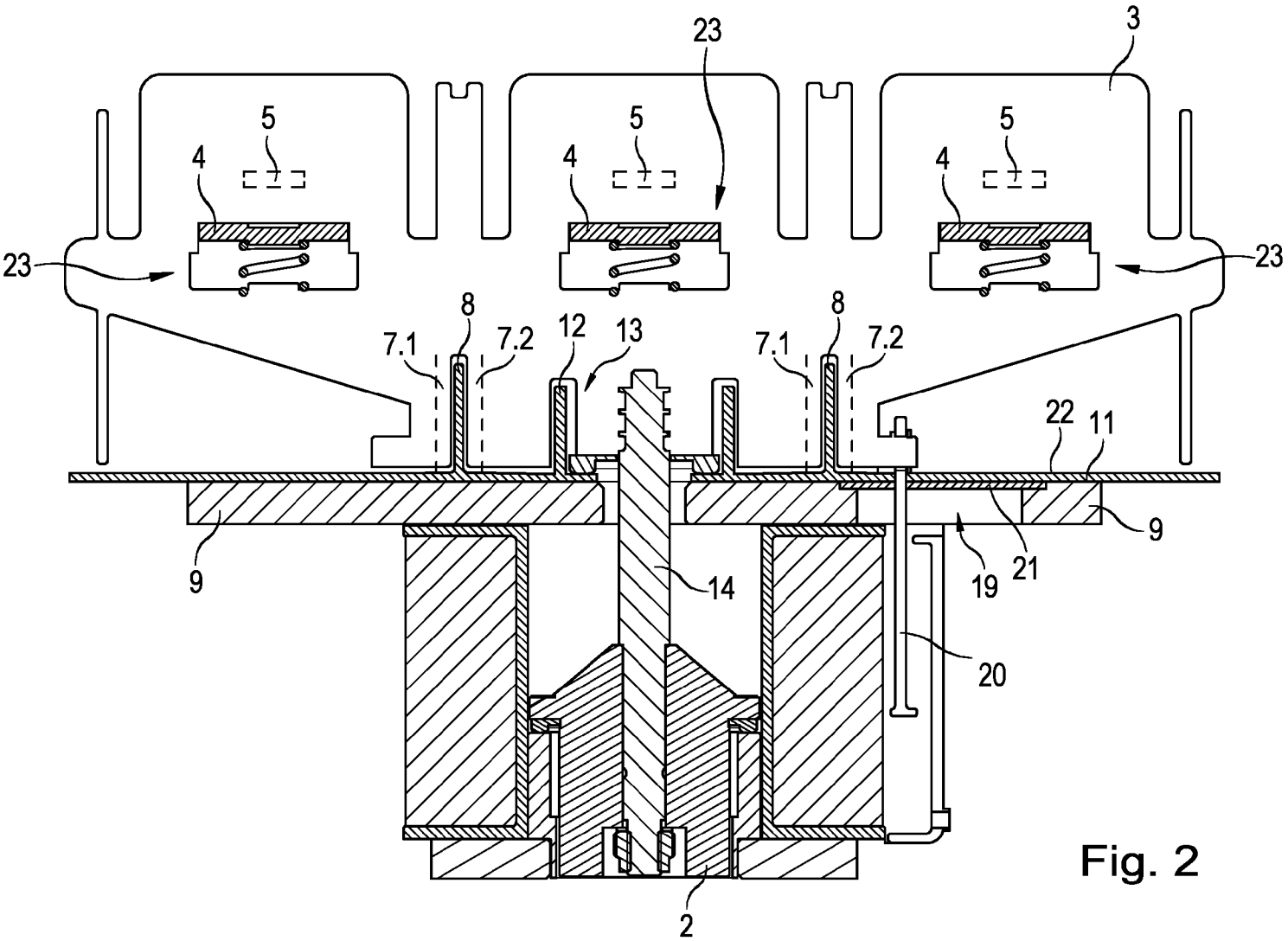
Figure 3:
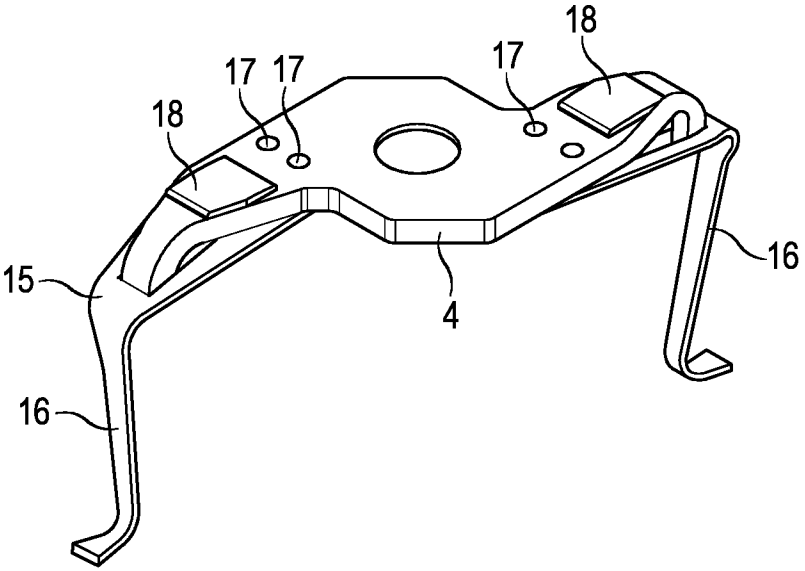

An embodiment of the present invention will be explained in greater detail by means of drawings in the following. The drawings show:

FIG. 1: a partially sectional oblique view of a power contactor according to the invention, FIG. 2: a schematic longitudinal section through the power contactor according to the invention from FIG. 1, FIG. 3: a detail view of the contact bridges of the power contactor according to the invention from the FIGS. 1 and 2.

In the following explanations, equal parts will be designated with equal reference signs. If a drawing contains reference signs that are not further described in the corresponding description of Figures, reference shall be made to preceding or subsequent descriptions of Figures.

FIG. 1 shows a partially sectional oblique view of a power contactor 1 according to the invention. The power contactor has a three-polar design and comprises three switching points that are arranged next to one another. The armature 2 of the electromagnetic drive is connected to a contact support 3 through an actuation axis 14. The contact support 3 of the power contactor has three contact bridge supports 23 that are shown in greater detail in FIG. 2, whereby each of the three contact bridge supports carries one of the three contact bridges 4 that are arranged next to one another. The three contact bridges form the movable contacts of the power contactor. One of the three contact bridge supports is arranged on the upper end of the actuation axis 14, which is actuated by the electromagnetic drive 2. The contact support 3 can be moved by means of the armature 2 from an open position, in which the movable contacts 4 and the respectively assigned fixed contacts 5 are not in contact with one another, into a closed position in which the movable contacts 4 come into contact with the fixed contact 5 and thereby create an electric connection. During opening of the contacts, a switching arc is formed, which has to be quenched as fast as possible, in particular in case of high loads to be switched, in order to prevent damage of the contacts or further components of the power contactor. An arc quenching device is therefore assigned to each contact point that consists of a movable contact 4 and a corresponding fixed contact 5. The quenching chambers 6 of the arc quenching devices are shown for 4 of the total of 6 contact points in FIG. 1.

In case of malfunction, it has to be possible to reliably switch off hundreds of kilowatts of electric power by means of the power contactor 1 under certain circumstances. The arc that is formed during switch-off creates a plasma that does not only remain in the direct area of the contact points for a short time, but that even moves to the adjacent switching point in the worst case. In this case, there is the risk of the arc flashing over onto the neighboring switching or contact point. To avoid this, a plasma barrier is provided between two adjacent contact points according to the invention. The plasma barrier essentially consists of separation walls that interact in the way of a labyrinth seal and that separate the corresponding contact points from one another. FIG. 2 shows that each plasma barrier has two plates 7.1 and 7.2 that are arranged in parallel to one another and that are connected firmly to the contact support 3. The contact support 3 and the plates preferably form one single component. The two plates 7.1 and 7.2 that are aligned in parallel to each other enclose between themselves another plate 8 that is connected to a stationary component of the power contactor. In the embodiment shown, a corresponding plastic plate 22, from which the central plate 8 essentially stands out perpendicularly, is installed on the yoke plate 9 of the power contact. The plates 7.1 and 7.2 cover the central plate 8 at least in part, and this in every position of the armature between the open and the closed position. Hence, the plates 7.1 and 7.2 interact with the plate 8 in the way of a labyrinth seal and therefore prevent effectively that plasma, which is created on one of the contact points by a switching arc, will move to the neighboring switching point.

To prevent the plasma from coming into contact with the yoke plate 9 or a grounded component of the power contactor that is arranged underneath and therefore creates a short circuit, additional measures were taken for the power contactor according to the invention pursuant to the shown embodiment. On one hand, an insulation film 11 is provided between the yoke plate 9 and the plastic plate 22 that lies on said yoke plate. In addition, practice has shown that a short circuit can also occur if the plasma comes into contact with a metal screw that is used for fixing of any component on the yoke plate 9. For example the arc quenching devices 6 are fixed on the yoke plate 9 by means of appropriate screws. To increase switchability, high-strength plastic screws 10 are provided for the power contactor according to the invention in order to fix components in immediate proximity to the respective contact points on the yoke plate.

In addition, a plasma barrier is provided opposite to the actuation axis 14 that is made of metal. It consists of a stationary insulation sleeve 12, which stands out from the plastic plate 22, and a moved insulation sleeve 13 that is part of the contact support 3. The stationary insulation sleeve 12 and the moved insulation sleeve 13 interact telescopically and in the way of a labyrinth seal. There is a very small distance between the sleeves, just as between the plates 8 and 7.1 and/or 7.2.

In addition, an auxiliary switch is provided for the power contactor, which is actuated via the armature. Therefore, a connection part 20 is connected to the contact support 3 in the shown power contactor according to the invention. The connection part 20 actuates an auxiliary contact that is arranged under the yoke plate 9 and is therefore guided through a breakthrough 19 in the yoke plate. To prevent plasma, which is formed during in the switching process, from coming into contact with the yoke plate 9 or with the grounded components of the power contactor that are arranged underneath said yoke plate, the breakthrough 19 is sealed by means of a foam rubber mat 21. Of course, the foam rubber mat has a much smaller breakthrough compared to the breakthrough 19 of the yoke plate 9 through which the connection part 20 is guided.

A further measure that was taken with regard to the power contactor according to the invention to increase switchability is shown in FIG. 3. FIG. 3 shows one of the three contact bridges 4 in detail. It displays the two contact areas 18 that come into contact with the corresponding fixed contacts 5 when the power contactor is closed. An arc guide horn 15, which essentially stands out perpendicularly, is arranged respectively on the two ends of the contact bridge 4. The arc guide horns 15 are made of bronze and riveted with the contact bridge 4. The riveting connections 17 are arranged in the central area of the contact bridge. The area 16 of the arc horns 15 that stands out perpendicularly is strongly tapered in order to achieve constriction of the magnetic field lines and hence reinforcement of the electromagnetic blowing effect.

The invention claimed is:

1. A multipolar power contactor (1) with an electromagnetic drive, a movable armature (2) and with at least two movable contacts (4) that are arranged next to one another and connected to the armature (2), whereby corresponding fixed contacts (5) of the power contactor (1) are assigned to the movable contacts (4), whereby the armature (2) can be moved from an open position, in which the movable contacts (4) and the fixed contacts (5) do not come into contact with one another, to a closed position, in which the movable contacts (4) come into contact with the fixed contacts (5), and whereby each contact point, which consists of a movable contact (4) and a corresponding fixed contact (5), is assigned an arc quenching device (6), whereby a plasma barrier is disposed between two movable contacts (4) that are arranged next to one another, whereby the plasma barrier has a first barrier (7) as well as a second barrier (8), whereby one of the two barriers (7) is connected to the armature (2) and the other one of the two barriers (8) to a stationary part (22) of the power contactor (1), and whereby the first barrier (7) and the second barrier (8) overlap at least partially with one another in each position of the armature (2) between the open and the closed position, wherein the armature (2) is connected to an actuation axis (14) made of metal, whereby the actuation axis (14) is enclosed at least partially by a stationary insulation sleeve (12) that is arranged in such a way that a contact of the actuation axis (14) with plasma, which is created by a switching arc that is formed during opening of the contact point, is prevented.

2. The power contactor (1) according to claim 1, wherein the first barrier (7) and the second barrier (8) interact in the way of a labyrinth seal.

3. The power contactor (1) according to claim 1, wherein the first barrier (7) and the second barrier (8) are each formed by at least one plate.

4. The power contactor (1) according to claim 3, wherein the first barrier (7) has at least two parallel plates (7.1, 7.2), whereby at least one plate of the second barrier (8) is arranged between the two parallel plates (7.1, 7.2) of the first barrier.

5. The power contactor (1) according to claim 1, wherein the barriers (7, 8) are made of plastic or ceramic.

6. The power contactor (1) according to claim 1, wherein the power contactor (1) has a yoke plate (9), whereby at least one component of the power contactor (1), which is installed in immediate proximity to one of the contact points on the yoke plate (9), is fixed on the yoke plate by means of one or multiple plastic screws (10).

7. The power contactor (1) according to claim 1, wherein the yoke plate (9) of the power contactor (1) is equipped at least partially with an insulation film (11) on the side that faces the contact points.

8. The power contactor (1) according to claim 1, wherein the actuation axis (14) is enclosed at least partially by a moved insulation sleeve (13) that is movable relative to the stationary insulation sleeve (12), whereby the moved insulation sleeve (13) is connected firmly to the actuation axis (14), and whereby the stationary insulation sleeve (12) and the moved insulation sleeve (13) interact telescopically.

9. The power contactor (1) according to claim 1, wherein the movable contacts (4) and/or the fixed contacts (5) are respectively designed with an arc guide horn (15), whereby the arc guide horns (15) are tapered at least in a sectional way.

10. The power contactor (1) according to claim 9, wherein the arc guide horn (15) is designed as a separate component and fastened on the corresponding fixed contact (5) and/or movable contact (4).

11. The power contactor (1) according to claim 1, wherein the yoke plate (9) of the power contactor (1) has a breakthrough (19) in the area of one of the contact points, whereby the breakthrough (19) is sealed with a foam rubber mat (21).

* * * * *